United States Patent [19]

Yoshida

[11] Patent Number: 4,690,247

[45] Date of Patent: Sep. 1, 1987

[54] INSPECTION CAR FOR BRIDGE CONSTRUCTION OF A HIGH LEVEL ROAD

[75] Inventor: Katunori Yoshida, Kumagaya, Japan

[73] Assignee: Nippon Light Metal Co., Ltd., Tokyo, Japan

[21] Appl. No.: 710,235

[22] Filed: Mar. 11, 1985

[51] Int. Cl.[4] ..... B66F 11/04

[52] U.S. Cl. ..... 182/63; 187/18; 187/19; 187/62.5; 182/148

[58] Field of Search ..... 182/63, 2, 18, 19, 62.5, 182/141, 148, 12; 187/9 E; 212/149, 153

[56] References Cited

U.S. PATENT DOCUMENTS

| | | | |
|---|---|---|---|
| 3,357,517 | 12/1967 | Wagner | 182/2 |
| 3,937,346 | 2/1976 | Vander Caan | 187/9 E |
| 4,074,790 | 2/1978 | Colbachini | 182/63 |
| 4,154,318 | 5/1979 | Malleone | 182/63 |
| 4,179,010 | 12/1979 | Ashworth | 182/2 |
| 4,456,093 | 6/1984 | Finley | 182/2 |
| 4,514,796 | 4/1985 | Saulters | 182/2 |
| 4,516,117 | 5/1985 | Couture | 212/153 |
| 4,556,124 | 12/1985 | Cotto | 182/63 |

FOREIGN PATENT DOCUMENTS

| | | | |
|---|---|---|---|
| 1146637 | 8/1959 | Fed. Rep. of Germany | 182/2 |

OTHER PUBLICATIONS

Barin, Automatic Bridge Control; 11-1982, p. 4.

*Primary Examiner*—Reinaldo P. Machado
*Assistant Examiner*—Alvin C. Shu
*Attorney, Agent, or Firm*—Oblon, Fisher, Spivak, McClelland, & Maier

[57] ABSTRACT

The inspection car is intended to inspect the lower side of the bridge construction of a high level road from above the high level road as well as from the ground and it comprises a swingable and extensible boom vertically swingably pivoted on a rotatable pedestal rotatably mounted on the chassis of the car about the vertical rotational axis of the pedestal, a reciprocal boom pivotally mounted on the tip of the swingable and extensible boom through a saddle, and an extensible inspection passageway pivotally connected to one end of the reciprocal boom, the passageway being swingable between a position parallel to the reciprocal boom and a position at right angle thereto while it is allowed to be rotated about the longitudinal axis of the reciprocal boom, a plurality of hydraulic cylinder means for the movement of the respective components listed above, and a control device for detecting the amount of movement of each component and controlling the movement thereof on the basis of the detected amount of movement of each component for the required operation of the inspection car. The control device has a function to judge the permission/inhibition of the movements of the respective components under predetermined conditions of the corelationship of the movements of the respective components.

6 Claims, 15 Drawing Figures

INSPECTION CAR FOR BRIDGE CONSTRUCTION OF A HIGH LEVEL ROAD

BACKGROUND OF THE INVENTION

The present invention relates to an inspection car for bridge construction of a high level road adapted to carry out inspection for maintainance of a high level road. High level roads have been increased as the development of exclusive roads for automobiles, superhighways or express highways for motor vehicles proceed.

In these high level roads, noise intercepting walls must be provided along the sides thereof where noise occuring from the traffic of automobiles must be suppressed against inhabitants residing near such high level roads. On the ground beneath the high level road, guard fences are often provided in order to prevent persons and vehicles from entering without notice.

The noise intercepting walls and the guard fences cause, however, obstruction against inspection of the bridge construction of the high level roads. For the inspection of the lowerside of the bridge construction of the high level road from the upper side thereof, for example, it is often made impossible to move the inspection stand or pedestal of the inspection car over the noise intercepting wall to a position required for the inspection, if the height of the wall is great. Further, even though in the case such a movement is possible, the steps of operations for effecting such a movement must be increased thereby rendering the operations to be very troublesome so that problems arise in the viewpoint of safety while quick operations can not be achieved.

For the inspection of the bridge construction of a high level road from the ground by moving the inspection pedestal of the inspection car over the guard fence, the traffic of motor vehicles on the ground must often be obstructed.

The above described difficulties are caused by the operating or manipulating mechanism of the inspection pedestal provided in the prior art inspection car.

SUMMARY OF THE INVENTION

The object of the present invention is to provide a novel and useful inspection car which avoids the above described difficulties occuring in the prior art inspection cars.

Another object is to provide a novel and usefull inspection car which makes it possible to easily and quickly carry out the operations for inspection of the bridge construction of a high level road even though high noise intercepting walls of the high level road or guard fences on the ground are provided.

To achieve the above described object, the inspection car of the present invention comprises a rotatable pedestal rotatably mounted on the chassis of the car so as to be rotatable about the vertical axis of the pedestal, a vertically swingable and extensible boom pivotally mounted on the rotatable pedestal, a vertically swingable saddle pivotally mounted on the tip of the swingable and extensible boom, an elongated reciprocal boom longitudinally reciprocal mounted in the saddle, an extensible inspection passageway or corridor swingably mounted on a rotatable supporting member rotatably secured to one end of the reciprocal boom so as to be swung in the vertical longitudinal center plane of the passageway, the supporting member being rotatable about the longitudinal axis of the reciprocal boom so that the passageway can not only swingable in the vertical longitudinal center plane thereof but also rotatable about the longitudinal axis of the reciprocal boom, and a double hydraulic cylinder mechanism consisting of a pair of stretching hydraulic cylinder and a pair of folding hydraulic cylinders each operatively coupling the saddle with the swingable and extensible boom so as to enable the saddle to be swung over a wide angle.

With the arrangement of the inspection car described above, when the inspection car is to be transported, the swingable and extensible boom, the reciprocable boom and the inspection passageway are folded back upon themselves horizontally together so as to assume the parallel positions closely adjacent to each other and located above the chassis closely adjacent thereto so that the transportation of the inspection car is facilitated.

For the inspecting operation from the upper side of the high level road, the swingable and extentible boom is vertically swung upwardly and extended over the noise intercepting wall after the rotatable pedestal is rotated to the required direction and then the saddle is swung so as to direct the reciprocable boom in the vertical direction and then the reciprocal boom is moved downwardly and the inspection passageway is swung so that is is positioned horizontally and in the desired direction for the inspection of the lower side of the bridge construction of the high level road.

Further, the inspection from the ground, the reciprocal boom is vertically moved so as to locate the inspection passageway horizontally above the guard fence but beneath the bridge construction in the similar manner as in the case of the inspection from the high level road.

The object of the present invention is also to provide a novel and useful inspection car of the type described above having a control device capable of controlling the movement of the various components of the inspection car to the required positions with the reduced number of steps of operations, while the components can be moved quickly.

The inspection car of the present invention described above comprises the rotatable pedestal, the swingable and extensible boom, the saddle, the reciprocal boom, and the double hydraulic cylinder mechanism, all of which are similar in construction as previously described, the swingable and extensible boom comprising a proximal boom member pivoted at its proximal end to the rotatable pedestal and a distal boom member slidably supported telescopically in the proximal boom member and extensible from the latter the stretching hydraulic cylinders being pivoted at their one ends to the distal end of the distal boom member, the other ends of the stretching hydraulic cylinders or the piston rods thereof being pivotally connected to the folding hydraulic cylinders one ends of which are pivoted to the saddle, the pivotally connected portions of the stretching hydraulic cylinders being swingably connected through a pair of connecting links to the pivoted portions of the saddle, respectively, the stretching hydraulic cylinders being arranged along the respective sides of the swingable and extensible boom, while the folding hydraulic cylinders are pivottally connected between the piston rods of the pair of stretching hydraulic cylinders, the inspection car being characterized by a control device including a detecting station adapted to detect at least the rotational angle of the swingable and extensible boom about the vertical axis of the rotatable pedestal and the vertical swinging angle of the swingable and extensible boom, the angle formed between the reciprocal boom and the swingable and extensible boom and the rotational angle of the inspection passageway about the longitudinal axis of the reciprocal boom obtained by the rotation of the supporting member, and the swinging angle of the passageway, and a descriminating station adapted to judge the permission/inhibition of the movements of the various components of the inspection car by comparing the signals received from the detecting station with the reference informations preliminarily set on the basis of the angular corelationship between the rotating or swinging angles of the various components of the inspection car thereby controlling the movements thereof to achieve the required relative positions of the various components upon permission of such movements.

With the above described inspection car of the present invention, it can be quickly operated for inspection of the required position of the bridge construction of the high level road from either of the high level road or the ground even though high noise intercepting walls are provided at the sides of the high level road and the guard fences are provided on the ground beneath the high level road, and the control device of the inspection car makes it possible to control the required movements not only of the swingable and extensible boom but also of the reciprocable boom and the inspection passageway in coupled relationship to each other by merely giving commands by the operator for swinging and rotating the swingable and extensible boom and the reciprocal boom and the passageway to the required positons, thereby simplifying the manual operations so that the security or safely of the operation of the inspection car is enhanced. Particularly, the steps of operations of the inspection car of the present invention can be greatly reduced even though high noise intercepting walls of the high level road and guard fences on the ground beneath the high level road are provided, while the space required for the operation is reduced and abstruction against the traffic of other vehicles on the ground can be greatly reduced.

BRIEF DESCRIPTION OF THE DRAWINGS

The present invention will now be described below with reference to a preferred embodiment thereof illustrated in the accompanying drawings, in which.

DETAILED DESCRIPTION OF THE PREFERRED EMBODIMENTS

Figure 1:
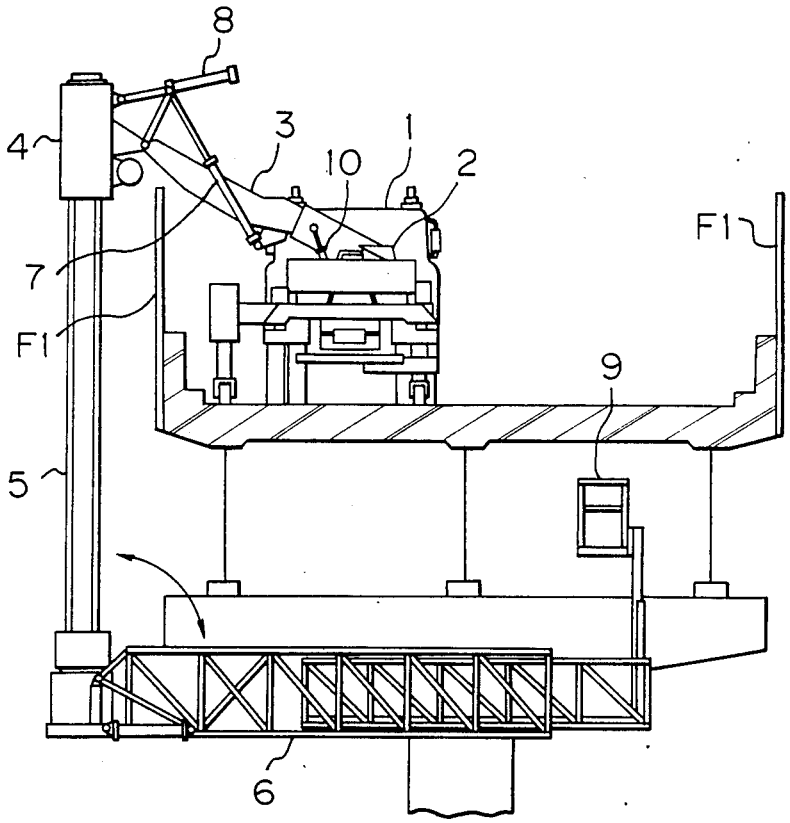
FIG. 1 is a rear view showing an embodiment of the inspection car having a control device for the inspection of the bridge construction of the high level road and constructed in accordance with the present invention in one mode of operations.
Figure 2:
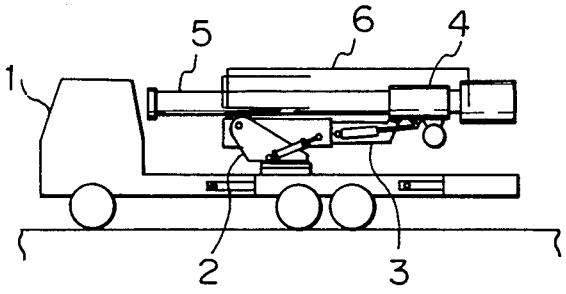
FIG. 2 is a side view of the inspection car of FIG. 1 in the mode of transportion thereof.
Figure 4:
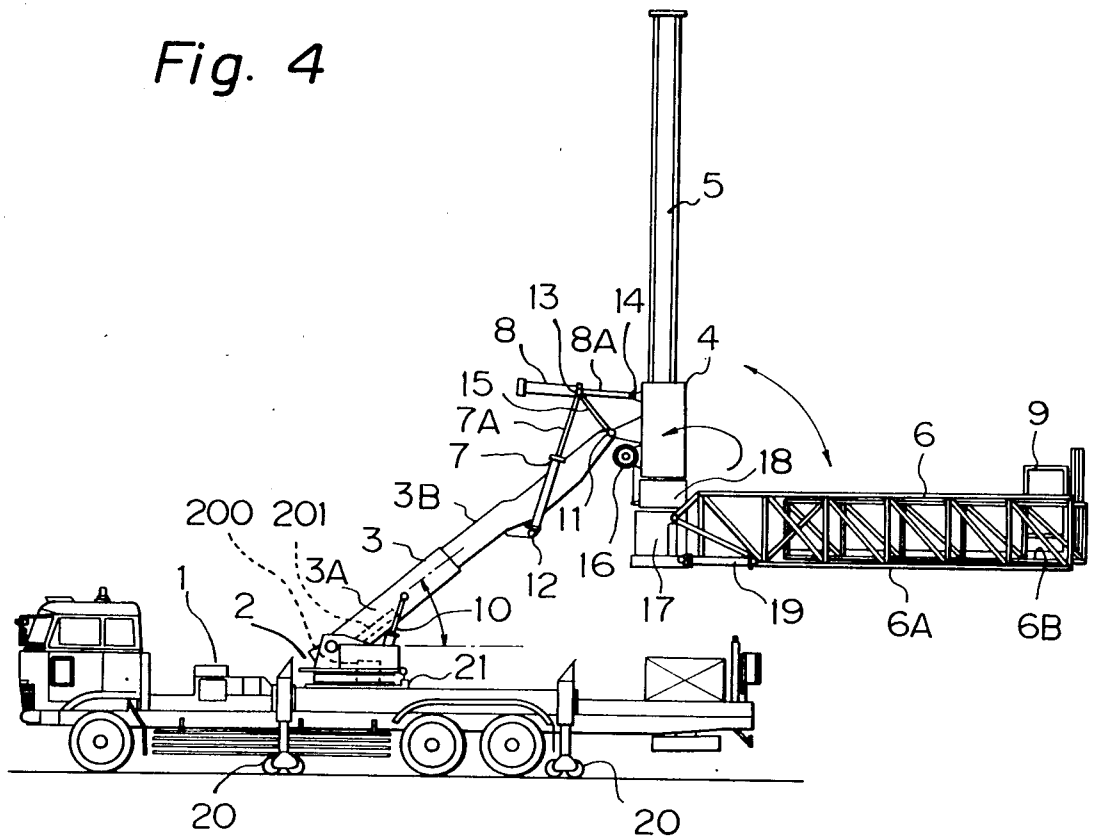
FIG. 4 is a side view of the inspection car of FIG. 1 showing the detailed construction thereof.

With reference to FIGS. 1 and 4, the inspection car of the present invention is provided with a rotatable pedestal 2 mounted on a chassis 1 of the car. The rotatable pedestal 2 is rotatable by the angle of 360 deg. about a vertical axis and is driven by a hydraulic motor 200 such as oil driven motor through a gear train (not shown). A vertically swingable boom 3 consists of a proximal boom member 3A and a distal boom member 3B. The proximal end of the proximal boom member 3A is pivotally supported on the rotatable pedestal 2 and the distal boom member 3B is telescopically slidably received in the proximal boom member 3A and is extensible from and contractable in the latter by means of a hydraulic cylinder 201 such as oil driven motor. The swingable and extensible boom 3 is swingable as a whole in the vertical plane by means of a hydraulic cylinder 10.

A saddle 4 is pivotally mounted on the tip of the distal boom member 3B by means of a pivot shaft 11 and is swingable in a vertical plane.

Figure 4A:
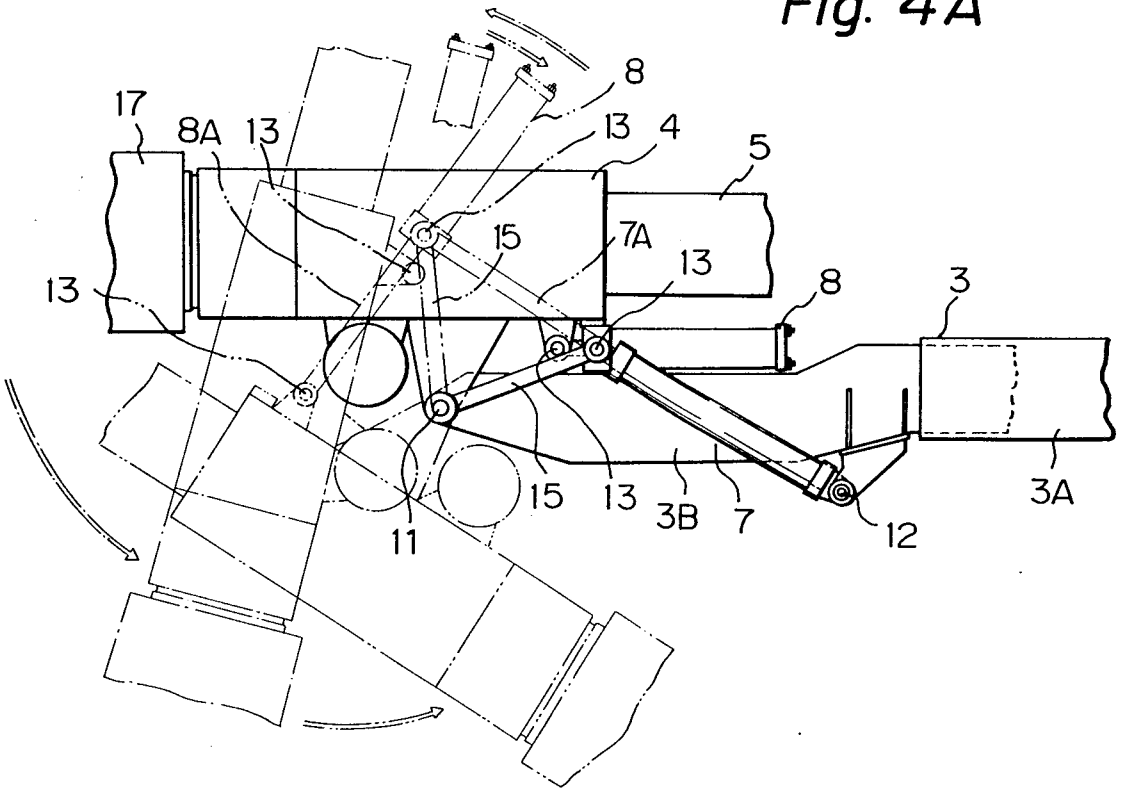
FIG. 4A is a fragmentary view in magnified scale showing the driving mechanism of the saddle of the inspection car of FIG. 1.

The piston rods 7A of a pair of stretching hydraulic cylinders 7 having their one ends pivotally supported on the respective sides of the distal boom member 3B by means of a pivot shaft 12 are pivotally connected to a pair of folding hydraulic cylinders 8 by means of a pivot shaft 13. The piston rods 8A of the folding hydraulic cylinders 8 are pivotally connected to the saddle 4 by means of a pivot shaft 14, while the pivot shaft 11 and the pivot shaft 13 are swingably connected through connecting links 15, respectively, so that a link mechanism is formed which permits the saddle 4 to be swung in the vertical plane about the pivot shaft 11. In other words, the saddle 4 can be swung over a wide range of angle by virtue of this link mechanism as shown in FIG. 4A.

The saddle 4 is formed as a hollow member and a reciprocal boom 5 is slidably received in the saddle 4. The reciprocal boom 5 is reciprocally driven in the longitudinal direction thereof in the saddle by means of a hydraulic motor 16 through a wire rope.

A supporting member 17 is mounted on the lower end of the reciprocal boom 5. The supporting member 17 is rotatable about the longitudinal axis of the boom 5 by appropriate hydraulic cylinder means.

An extensible inspection passageway or corridor 6 is swingably supported at its proximal end to the supporting member 17 by means of a pivot shaft 18 and is swingably driven in its vertical longitudinal center plane by means of a hydraulic cylinder 19.

The inspection passageway 6 is also rotatable about the longitudinal axis of the reciprocal boom 5 by rotating the supporting member 17. The inspection passageway 6 is swingable by the hydraulic cylinder 19 between a position in parallel to the reciprocal boom 5 closely adjacent thereto and a position extending radially from the boom 5 substantially at right angle.

The inspection passageway 6 consists of a passageway 6A with its proximal end pivotally supported to the supporting member 17 and a distal passageway 6B slidably supported in the proximal passageway 6A and extensible from and entractable in the latter by the operation of an appropriate driving means. An inspection pedestal 9 is mounted on the distal passageway 6B and can be elevated and descended with respect to the distal passageway 6B by appropriate driving means (not shown). Rails 70 are preferably provided in the destal passageway 6B and a carriage 71 is movably supported thereon on which the inspection pedestal 9 is vertically movably mounted as shown in FIG. 4B.

Figure 4B:
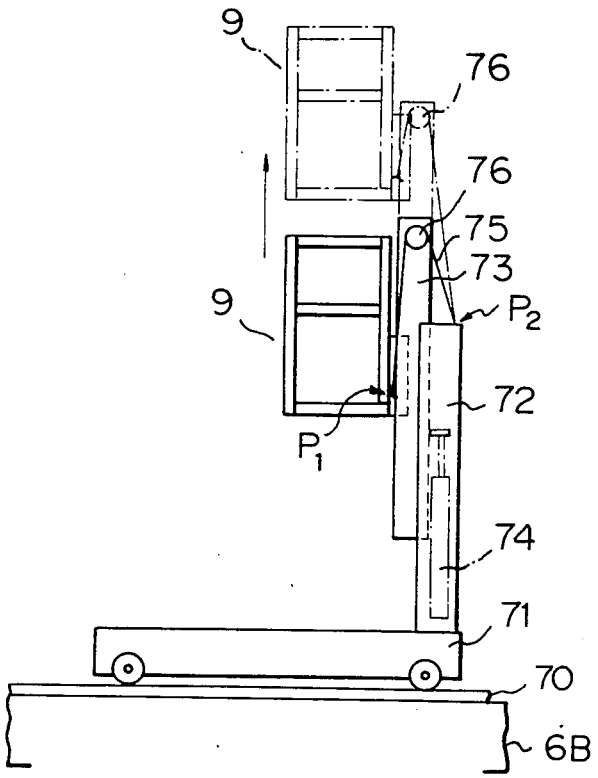
FIG. 4B is a fragmentary view in magnified scale showing the detailed instruction of the elevating mechanism of the inspection pedestal of the inspection car of FIG. 1.

In the construction shown in FIG. 4B, the carriage 71 is provided with a first upright post 72 fixedly secured thereto and a second upright post 73 slidably supported on the first post 72 along the longtudinal direction thereof. The second post 73 is driven by a hydraulic cylinder 74.

The inspection pedestal 9 is slidably mounted on the second post 73 therealong and a pair of wires 75 secured at one of their ends to either sides of the bottom portion P of the pedestal 9 and at their other ends to either sides of the top P of the first post 72 are stretched around idler pullays $76^2$ rotatably supported on the top of the second post 73, respectively, the length of each wire 75 being so set that the inspection pedestal 9 is just located adjacent to the carriage 71 when the second post 73 is in its descended position. Thus, the inspection pedestal 9 is effectively elevated quickly by raising the second post 73 by the operation of the hydraulic cylinder 74.

An appropriate number of outriggers 20 are provided on either sides of the chassis 1 of the inspection car which are appropriately driven by hydraulic driving means (not shown), and detecting means such as limit switches, encoders and the like are provided so as to permit the swinging angles of the respective booms, 3, 5, the saddle 4 and the inspection passageway 6, the elevated or descended position of the reciprocal boom 5, the rotational angles of the ratatable pedestal 2 and the supporting member 17, the extended or contracted position of the distal boom member 3B and the distal passageway 6B, and the operating conditions of the outriggers 20, etc. to be detected during the required conditions of operations of the inspection car. The above described required conditions of operations mean that, in case the extended condition of the boom 3 is to be detected, for example, an appropriate number of increments of extension or extending steps are preliminarily set and the detection is so carried out that which of the steps is detected where the boom 3 is actually extended, the number of steps being selected so as to satisfy the required accuracy of detection of extended amount of the boom 3, such detecting means being well known and not described in detail here.

Figure 5:
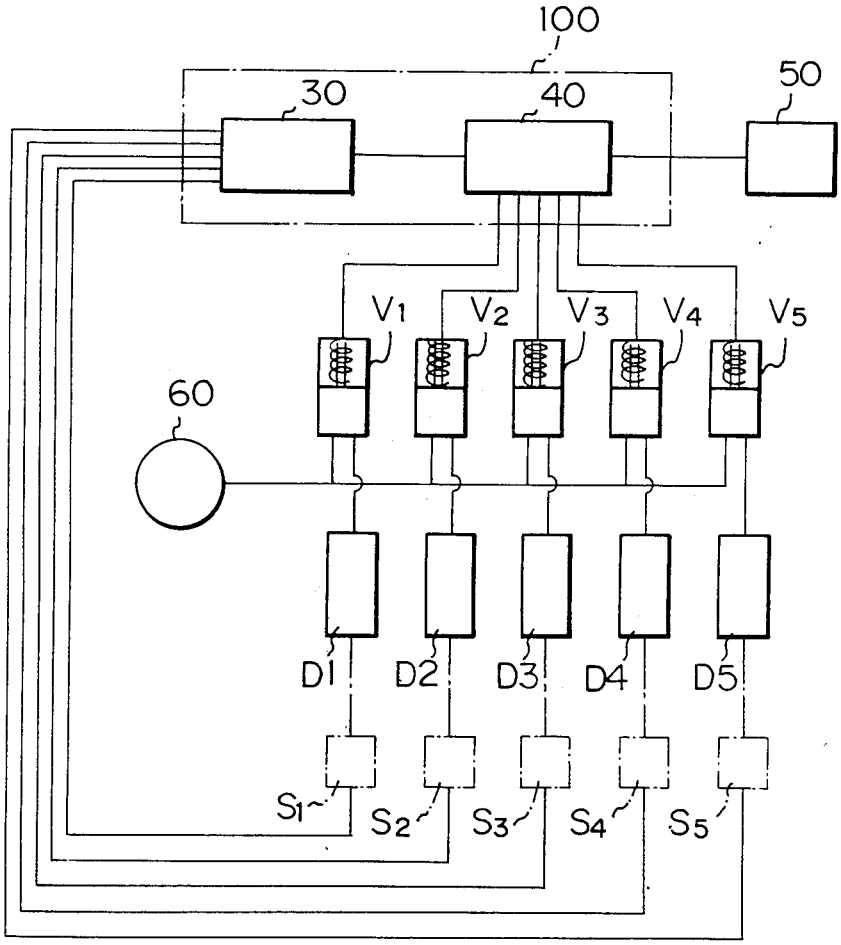
FIG. 5 is a black diagram showing an embodiment of the control device of the present invention.

The control device characterizing the inspection car of the peresent invention is shown in FIG. 5. In FIG. 5, the control device 100 comprises a detecting station 30 and a discriminating station 40. The detecting station 30 has the function to receive the detected signals issued by the detecting means $S_1$, $S_2$, . . . for detecting the operating conditions of the various components of the inspection car described above and to ascertain the successive operating conditions thereof. To this end, it is provided with an appropriate memory circuit and is adapted to issue data signals relating to the conditions of the components to the discriminating station 40 on the basis of the commands therefrom. The discriminating station 40 has the function to judge the permisson/inhibition of operations of the respective components. To this end, it is provided with a discriminating circuit for preliminarily setting the operating conditions of the respective components in coupled relationship with each other. When a command is given to the discriminating circuit from a manupulation board 50 by the operation of an operator, it functions to judge whether or not the respective components are permitted to operate in accordance with the command given from the manupulation board 50 in relation to the operations of the remaining components. When the components are judged to be allowed to operate, the discriminating station 40 issues switching signals to the restective valve means $V_1$, $V_2$, . . . belonging to the components permitted to operate so that hydraulic or oil pressure is supplied from a pump 60 to the respective hydraulic driving menas $D_1$, $D_2$, ... belonging thereto, respectively, thereby actuating the respective components allowed to operate as required in accordance with the command.

Thus, insofar as the detecting station 30 is detecting the fact by the signals from the detecting means that, for example, the outriggers 20 are not properly set for the required operation of the inspection car, the movement of the swingable and extensible boom 3 toward the lateral direction with respect to the longitudinal axis of the inspection car and the extension of the inspecting passageway 6 laterally of the inspection car are inhibited so as to prevent lateral overturn of the inspection car.

The contents of the operating conditions can be variously set and such settings can be achieved by the combination of the detecting station 30 with the discriminating station 40 wherein microcomputors are incorporated. Such a construction per se is conventional for devised by a person skilled in the art and is not described in detail here.

The operation of the inspection car as described above will be described below.

Figure 6:
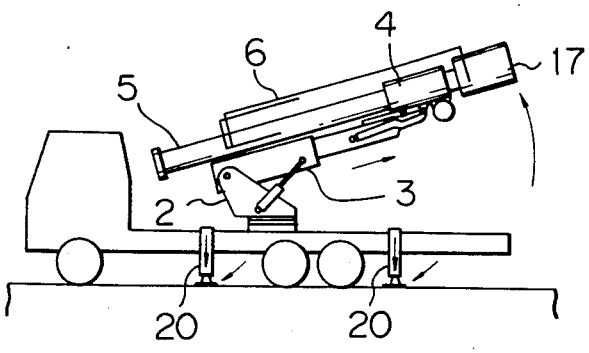
FIGS. 6–9 inclusive are side views showing various steps of operations of the inspection car of FIG. 1.
Figure 7:
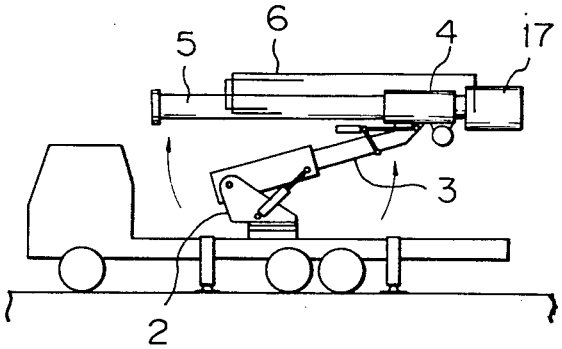

For the inspecting operation, the outriggers 20 which may be provided with wheels are first set for securing the inspection car as shown in FIG. 6. Then, the right-hand end at the side of the supporting member 17 of the assembly of the booms 3 and 5 and the passageway 6 each held folded back upon themselves in parallel to each other is raised as shown in FIG. 6, or the boom 3 is swung upwardly with the boom 5 and the passageway 6 being maintained in the horizontal positions, as shown in FIG. 7.

Figure 8:
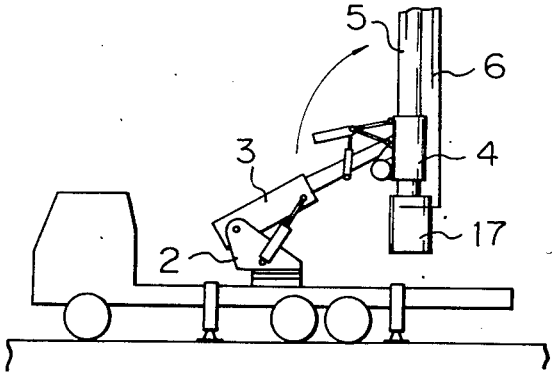

Thereafter, the boom 5 and the passageway 6 are swung together to the upright positions as shown in FIG. 8.

Figure 9:
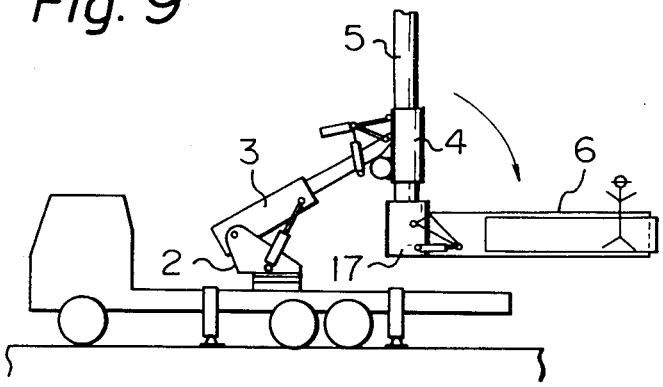

Thereafter, the inspection passageway 6 is swung to the horizontal position as shown in FIG. 9. In this horizontal position of the passageway 6, the reciprocal boom 5 is once descended so that the operator can enter the passageway 6.

Figure 3:
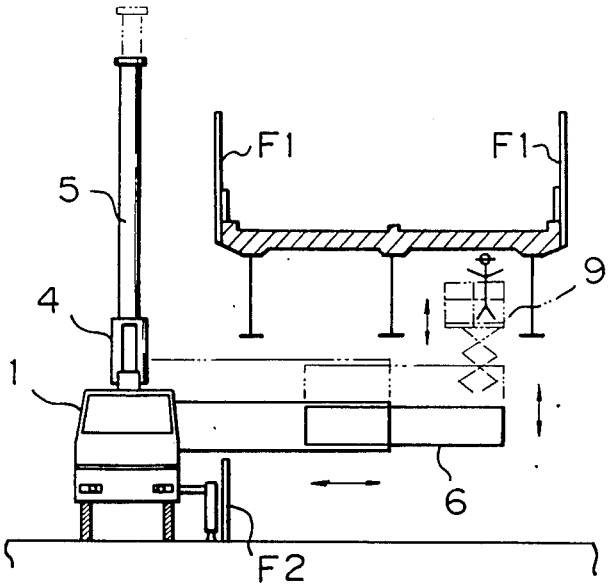
FIG. 3 is a front view of FIG. 1 shown in another mode of operation.
Figure 10:
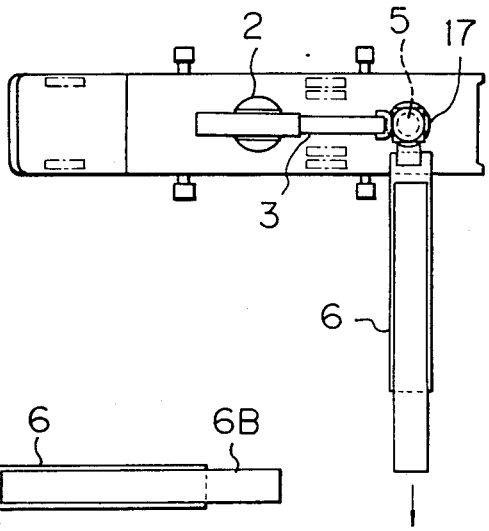
FIGS. 10 and 11 are plan view showing the various steps of operation of the inspection car of FIG. 1.

For the inspection from the ground as shown in FIG. 3, the passageway 6 is rotated in the horizontal plane to the position as shown in FIG. 10, and then the boom 5 and the inspection pedestal 9 are elevated to the required heights, respectively, as shown in FIG. 3. The inspection is carried out in this position.

Figure 11:
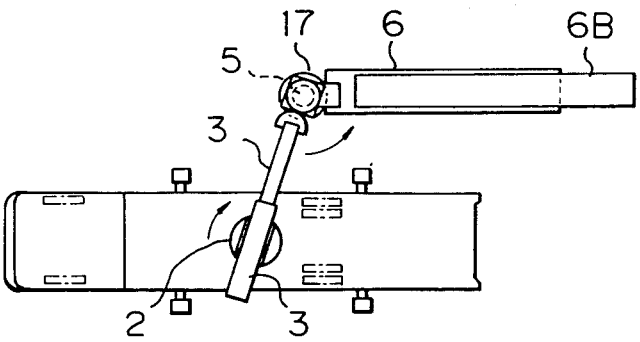

For the inspection from the high level road as shown in FIG. 1, the boom 3 is rotated from the position shown in FIG. 9 to the position shown in FIG. 11, while the passageway 6 is held in parallel to the longtudinal axis of the chassis 1, so that the passageway 6 is moved out of the side of the high level road, and then the reciprocal boom 5 is descended until the passageway 6 is positioned at the required level. Thereafter, the passageway 6 is rotated in the horizontal plane beneath the high level road to the required direction, and the height of the inspection pedestal 9 is adjusted. In this position, the inspection is carried out.

In case noise intercepting walls and guard fences are provided, the boom 3 and the passageway 6 are elevated to positions sufficient to permit the boom 3 and the passageway 6 to be extended over the noise intercepting wall or the guard fence.

These operations are carried out by giving a command from the manipulating board 50 to the control device 100 so that the respective components can be operated as required only when the discriminating station 40 judges that such operations are allowed, thereby insuring the safety of operation of the inspection car.

The control operation of the control device of the present invention will now be described in detail below.

Figure 12:
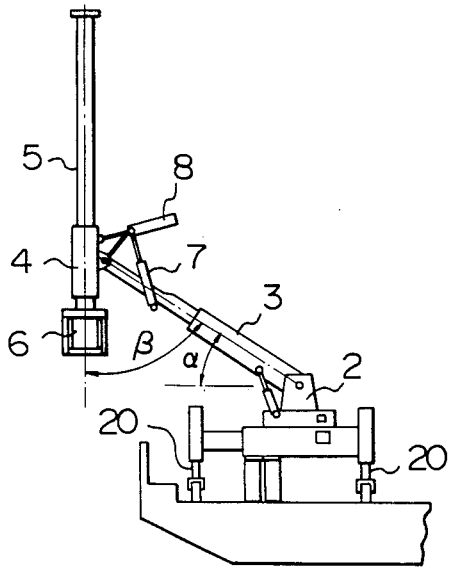
FIG. 12 is an end view showing the steps of operations for raising the swingable and extensible boom and locating the reciprocal boom in the elevated upright position.

When the angle of the swingable and extensible boom 3 is to be varied from the position shown in FIG. 9 to the position shown in FIG. 12, the control device operates to automatically control the movement of the saddle 4 so that the reciprocal boom 5 is always maintained in its vertical position during the movement of the boom 3 as shown in FIG. 12.

In the similar manner, when the boom 3 is to be elevated with the reciprocal boom 5 and the passageway 6 being maintained in the horizontal positions as shown in FIG. 7, the control device operates to automatically control the movement of the saddle 4 in response to the variation in the angle of the boom 3 so as to maintain the reciprocal boom 5 and the passageway 6 in their horizontal positions. Such coupled movements as described above are achieved by the operation of the control device 100. To this end, the control device 100 carries out the computing operation of the angles of the boom 5 and the passageway 6 on the basis of the feed-back signals from the respective detecting means in order to control the energization of the stretching hydraulic cylinders 7 and the folding hydraulic cylinders 8 in coupled relationship to the command for energizing the hydraulic cylinder 10 for driving the boom 3 so that the boom 5 and the passageway 6 are moved in the manner as required. Such computing operations per se are well known and, therefore, detailed description thereof is not given here.

Figure 13:
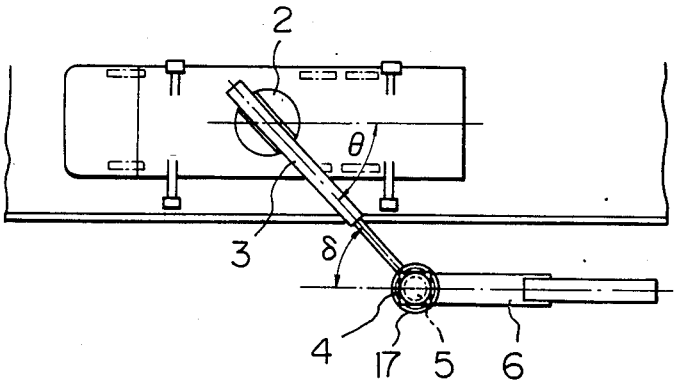
FIG. 13 is a plan view showing one mode of operations of the inspection car of FIG. 1.

Further, when the swingable and extensible boom 3 is to be swung in case the passageway 6 is extended at its entirely over the noise intercepting wall of the high level road on which the inspection car is located as shown in FIG. 13, the control device can control the swinging movement of the passageway 6 in coupled relationship to the swinging movement of the swingable and extensible boom 3 in such a manner that the swinging angle delta of the passageway 6 is maintained at all times at the same angle as the swinging angle theta of the boom 3. Such a control operation is also effected by the control device 100 on the basis of the appropriate computing operation thereof.

Such coupled control operations can be carried out automatically by the command issued from the manipulation board 50 by the operation of the operator or by setting the discriminating station 40 for the coupled automatic movements of the respective components with each other. Such coupled movements of the respective components may be released, if necessity arises.

What is claimed is:

1. An inspection car for inspecting bridge construction of a high level road comprising a rotatable pedestal rotatably mounted on a chassis about a vertical axis, a vertically swingable and extensible boom with its proximal end pivotally mounted on said rotatable pedestal, a reciprocal boom longitudinally slidably and reciprocally fitted in a saddle pivotally mounted on the distal end of said swingable boom, and an inspection passageway with its proximal end pivotally mounted on one end of said reciprocal boom so as to be swung in the vertical longitudinal center plane of said passageway as well as to be rotated about the longitudinal axis of said reciprocal boom, a pair of stretching hydraulic cylinder means arranged along either side of said swingable boom with one of the ends thereof being pivotally supported on a distal boom member of said swingable boom, and folding hydraulic cylinder means having one of the ends pivotally connected to said saddle, the other of the ends of said stretching hydraulic cylinder means or piston rods therof being pivotally connected to said folding hydraulic cylinder means, the portion at which said stretching hydraulic cylinder means or said piston rods thereof are pivotally connected to said folding hydraulic cylinder means being relatively swingably connected through connecting links to the portion at which said hydraulic cylinder means being pivotally connected between the forward ends of the respective piston rods or the stretching hydraulic cylinder means, a control device comprising a detecting station for detecting and ascertaining at least the rotational angle of said swingable boom about the rotational axis of said rotatable pedestal, the vertical swinging angle of said swingable boom, the angle formed between the longitudinal axis of said reciprocal boom and said swingable boom, and the rotational angle of said passageway about said reciprocal boom, and a discriminating station adapted to receive the detected signals from said detecting station so as to judge the permission/inhibition of movements of the respective components of the inspection car on the basis of a predetermined correlationship between the movements of the respective components for effecting such movements upon permission.

2. Inspection car according to claim 1, wherein said swingable boom comprises a plurality of boom members telescopically and slidably fitted with each other so as to be extended in a plurality of steps.

3. Inspection car according to claim 1, wherein said control device comprises means for carrying out the computing operation on the basis of the vertical swinging angle of said swingable boom and the swinging angle of said reciprocal boom given by the swinging movement of said saddle so as to permit said reciprocal boom to be maintained in the vertical position in coupled relationship to the movement of said swingable boom.

4. Inspection car according to claim 1, wherein said control device comprises means for carrying out the computing operation on the basis of the rotational angle of said swingable boom about the rotational axis of said rotatable pedestal and the rotational angle of said passageway about the longitudinal axis of said reciprocal boom so as to maintain said passageway in parallel to the longitudinal direction of said chassis in coupled relationship to the rotational movement of said swingable boom about the rotational axis of said rotatable pedestal.

5. Inspection car according to claim 1, wherein said inspection passageway comprises a plurality of passageway sections telescopically and slidably engaged with each other thereby permitting said passageway to be extended by sliding said sections in the outward direction from each other.

6. Inspection car according to claim 1, wherein said inspection passageway is provided with a carriage movable in the longitudinal direction of said passageway and an inspection pedestal mounted on said carriage, said inspection pedestal being capable of being elevated and descended with respect to said carriage when said carriage is provided with a first fixedly secured upright post and a second upright post slidably supported on said first post along the longitudinal direction of said first post and wherein said second post is driven by a hydraulic cylinder means and said inspection pedestal is slidably mounted on said second post with said pedestal having a bottom portion connected to one end of each of a pair of wires and the other end of each of said pair of wires is connected to the top of said first post and said wires are stretched around a pair of idler pulleys rotatably supported on the top of said second post with the length of each wire being set so that said inspection pedal is located adjacent to said carriage when said second post is in its descended position and thereby the pedestal is elevated quickly by raising said second post by the operation of said hydraulic cylinder.

* * * * *